US005499414A

United States Patent [19]

Dillon

[11] Patent Number: 5,499,414

[45] Date of Patent: Mar. 19, 1996

[54] INNERSPRING CONSTRUCTION INCLUDING IMPROVED EDGE CHARACTERISTICS

[75] Inventor: Paul J. Dillon, Roswell, Ga.

[73] Assignee: Simmons Company, Atlanta, Ga.

[21] Appl. No.: 238,835

[22] Filed: May 5, 1994

[51] Int. Cl.[6] ..... A47C 25/02

[52] U.S. Cl. ..... 5/474; 5/261; 5/475; 267/95; 267/97; 267/107

[58] Field of Search ..... 5/474, 476, 260, 5/261; 267/95, 96, 97, 107

[56] References Cited

U.S. PATENT DOCUMENTS

| | | | |
|---|---|---|---|
| 2,568,829 | 9/1951 | Scott et al. . | |
| 2,843,191 | 7/1958 | Regan . | |
| 2,857,603 | 10/1958 | Rymland | 5/260 |
| 3,200,417 | 8/1965 | Costello . | |
| 3,305,879 | 2/1967 | Krakauer | 5/260 |
| 3,325,831 | 6/1967 | Crosby et al. | 5/474 X |
| 3,370,619 | 2/1968 | Docker . | |
| 3,426,371 | 2/1969 | Robinson | 5/260 |
| 3,472,290 | 10/1969 | Sykes et al. . | |
| 3,638,254 | 2/1972 | Falkenau . | |
| 3,722,013 | 3/1973 | Surletta . | |
| 3,824,639 | 7/1974 | Mandusky . | |
| 3,825,960 | 7/1974 | Inman et al. . | |
| 3,833,948 | 9/1974 | Surletta et al. . | |
| 3,835,485 | 9/1974 | Klicki . | |
| 3,982,290 | 9/1976 | Ward | 5/260 |
| 4,000,531 | 1/1977 | Inman . | |
| 4,068,329 | 1/1978 | Gross et al. . | |
| 4,195,376 | 4/1980 | Kitchen . | |
| 4,207,634 | 6/1980 | Kitchen et al. . | |
| 4,339,834 | 7/1982 | Mizelle . | |
| 4,398,705 | 8/1983 | Mizelle . | |
| 4,452,438 | 6/1984 | Hancock et al. . | |
| 4,470,584 | 9/1984 | Mizelle . | |
| 4,489,450 | 12/1984 | Miller . | |
| 4,595,180 | 6/1986 | Hagemeister . | |
| 4,654,905 | 4/1987 | Miller . | |
| 4,770,397 | 9/1988 | Schulz, Jr. . | |
| 4,790,038 | 12/1988 | Ikeda . | |

FOREIGN PATENT DOCUMENTS

| | | |
|---|---|---|
| 1104884 | 3/1968 | United Kingdom . |

*Primary Examiner*—Michael F. Trettel
*Attorney, Agent, or Firm*—Jones, Day, Reavis & Pogue

[57] ABSTRACT

An improved innerspring construction such as a mattress or box spring unit which includes improved edge support characteristics. A torsion edge support unit is disclosed which may be placed about the periphery of an innerspring construction with a minimum of interference with more interiorly-positioned coil springs.

15 Claims, 8 Drawing Sheets

INNERSPRING CONSTRUCTION INCLUDING IMPROVED EDGE CHARACTERISTICS

TECHNICAL FIELD

This invention relates in general to bedding, namely innerspring constructions, and particularly relates to a mattress or box spring construction which includes torsion edge support units which are placed about the edge of a mattress or box spring and which provide space-efficient additional firmness at the edge of the mattress or box spring, and offer improved edge stability characteristics combined wide mattress side wall integrity.

BACKGROUND OF THE INVENTION

In mattress or box spring construction it is known to provide wire springs within a mattress or box spring which cushion loads placed thereupon, such as loads created by a person or persons sitting or reclining upon such bedding. An example of such a configuration is shown in U.S. Pat. No. 3,825,960 to Inman, incorporated by reference.

A need has been recognized in the bedding industry to provide additional support about the peripheral edge of a mattress or a box spring to accommodate loads due to users sitting or lying on a bed, to preclude a "rolling off" or "set" effect often encountered at the edges of mattresses or box springs. Examples of such configurations are known in the art, such as shown in U.S. Pat. No. 4,195,370 to Kitchen, incorporated by reference which discloses the use of spring members which provide additional support at the end of a box spring. However, a need has been recognized to provide innerspring constructions such as mattresses or box springs which include additional peripheral edge support, and also provide for space-efficient use of springs within the innerspring construction.

SUMMARY OF THE INVENTION

The present invention overcomes weaknesses in the art by providing an innerspring construction such as a mattress or box spring which includes the use of edge support units which provide additional support about the peripheral edge of a mattress or box spring, while providing space-efficient use of the units with minimal interference between the units and interior springs.

The use of torsion edge support units as provided by the invention provides a firmer edge, which provides resistance to disadvantageous edge breakdown or edge setting due to continuous use. This is a particular problem when a user regularly sits on the edge of a mattress. A firmer edge also tends to minimize the likelihood that an occupant will "roll out" of bed during sleeping.

Generally described, the present invention provides an innerspring mattress construction comprising an upper peripheral border wire having an elongate portion lying along a first axis; a lower peripheral border wire having an elongate portion lying along a second axis, the first and second axes lying within an innerspring construction side wall plane; at least one coil spring providing spring resistance to a force placed atop the mattress innerspring construction; a torsion edge support unit having an upper horizontal portion attached to the elongate portion of the upper peripheral border wire and having a lower horizontal portion attached to the elongate portion of the lower peripheral border wire, and having a first torsion bar positioned within the spacial volume of the interior coil spring and a second torsion bar lying approximately in the same plane as the innerspring construction side plane, the torsion edge support providing resistance to a force tending to urge the respective elongate portions of the upper and lower border wires closer together.

Therefore, it is an object of the present invention to provide a mattress or box spring which includes an improved means of peripheral edge support which provides side wall integrity.

It is a further object of the present invention to provide a mattress or box spring construction which includes an improved means of edge support which is effective in operation.

It is a further object of the present invention to provide a mattress or box spring construction which includes an improved means of edge support which does not tend to squeak when encountering a load.

It is a further object of the present invention to provide a mattress or box spring construction which includes an improved means of edge support which is simple to assemble.

It is a further object of the present invention to provide a mattress or box spring construction which includes an improved means of edge support which is simple in construction.

It is a further object of the present invention to provide a mattress or box spring construction which includes an improved means of edge support which is space-efficient in design and construction.

Other objects, features, and advantages of the present invention will become apparent upon reading the following detailed description of the preferred embodiment of the invention when taken in conjunction with the drawing and the appended claims.

DETAILED DESCRIPTION OF THE PREFERRED EMBODIMENT

Figure 1:
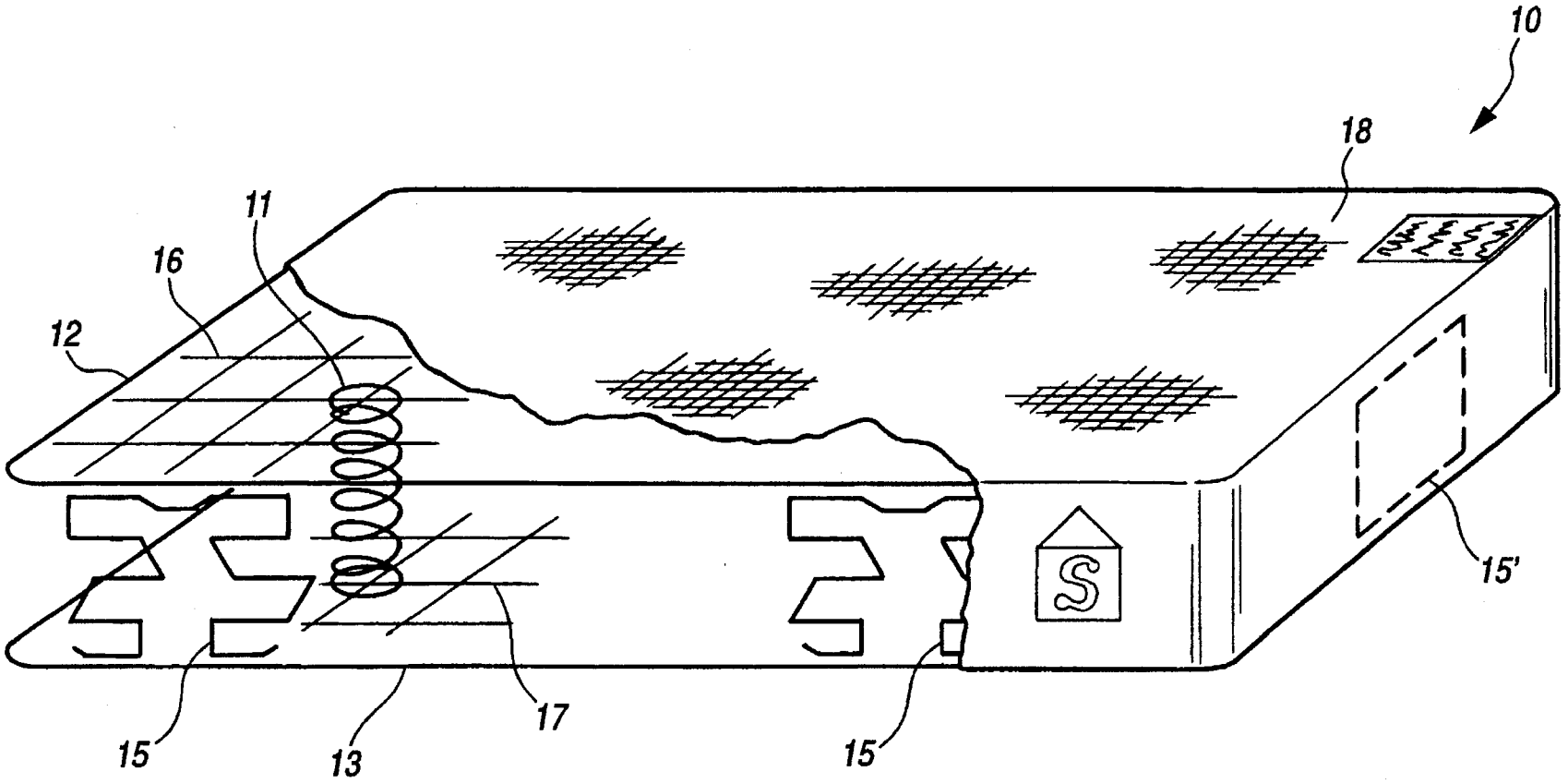
FIG. 1 is a partial cut-away pictorial view of an upholstered mattress or box spring construction according to the present invention.

Referring now to FIG. 1, a mattress construction 10 according to the present invention is shown which includes a plurality of open-coil interior springs 11, upper and lower peripheral border wires 12, 13, respectively, and a plurality of torsion edge support units 15 which provide additional support about the peripheral edge of the mattress innerspring construction. One such edge support unit 15 is shown in isolation in FIGS. 3 and 4.

Figure 2:
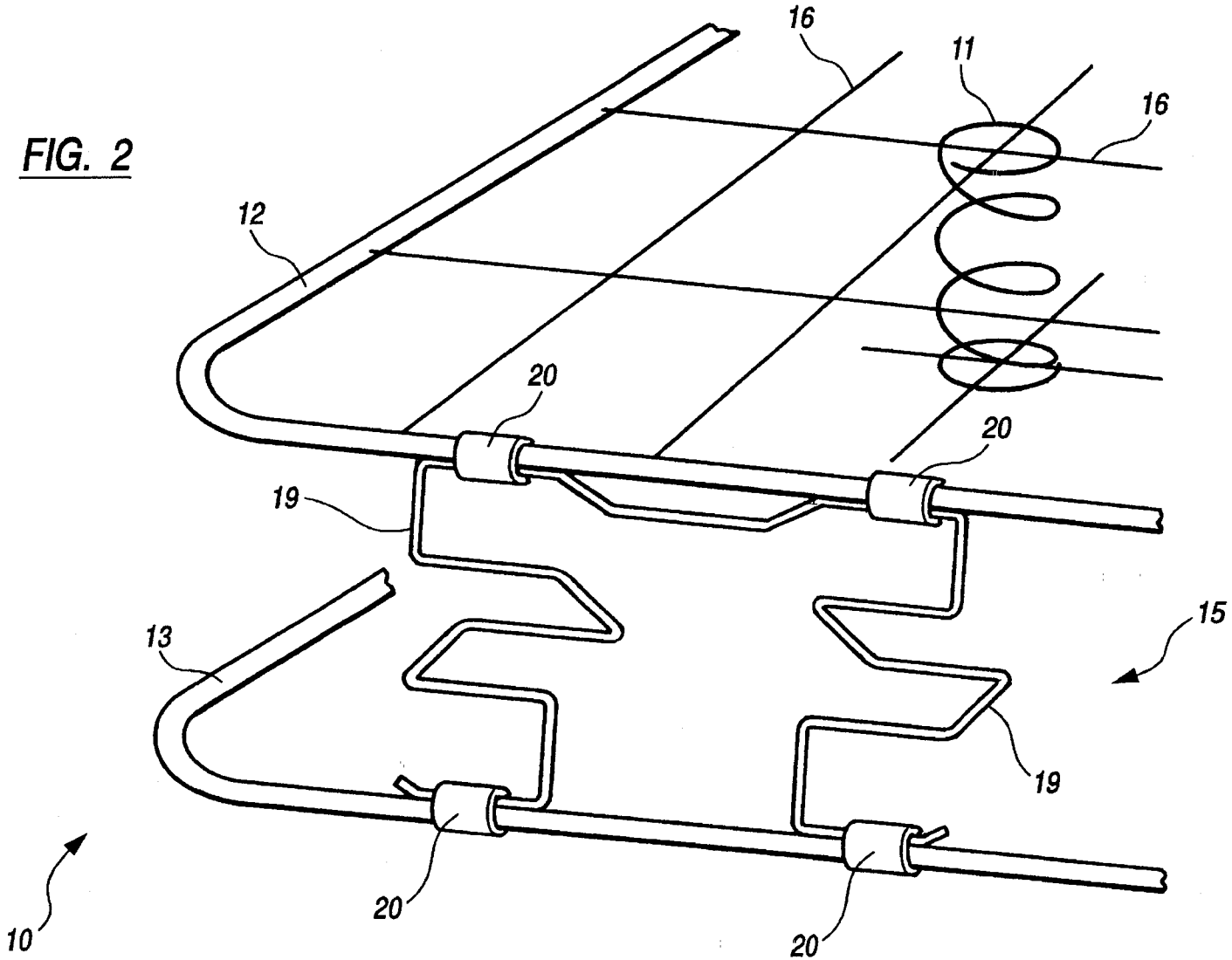
FIG. 2 is a pictorial partial view of a corner portion of an innerspring mattress construction according to the present invention.

As shown in FIG. 2, each torsion edge support unit 15 is attached to the upper border wire 12 at its upper end by a pair of upper clips 20, and is attached to the lower border wire 13 at its lower end by a pair of lower clips 20. An interior coil spring 11 (shown as an open coil), along with a plurality of other interior springs (not shown), provides support to loads placed atop the upper surface of the mattress 10. The coils may be individual as shown and attached to typical grid wires 16 (see also FIG. 1), or may alternately be of the continuously-coiled variety; the important feature to note is the existence of interior coil springs providing support between the opposing mattress support surfaces. Such a continuous-coiled construction is such as disclosed by U.S. Pat. No. 4,790,038 to Ikeda incorporated by reference.

Figure 4:
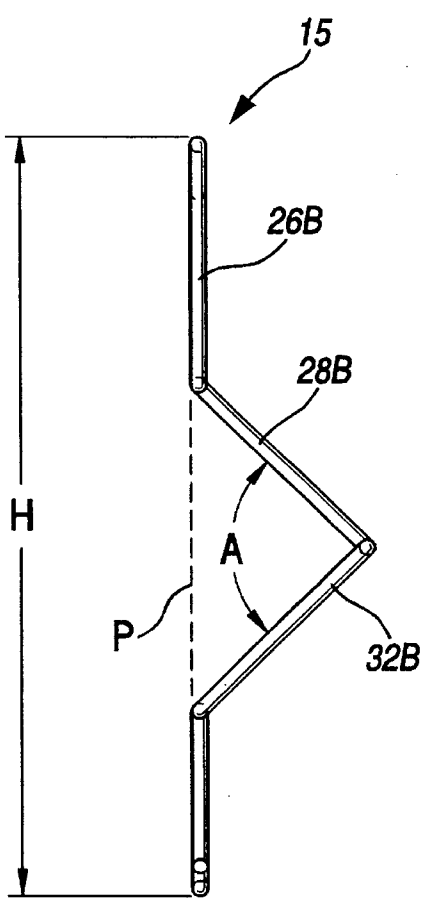
FIGS. 3 and 4 are front and side plan views, respectively, of a first torsion edge support unit according to the present invention.
Figure 3:
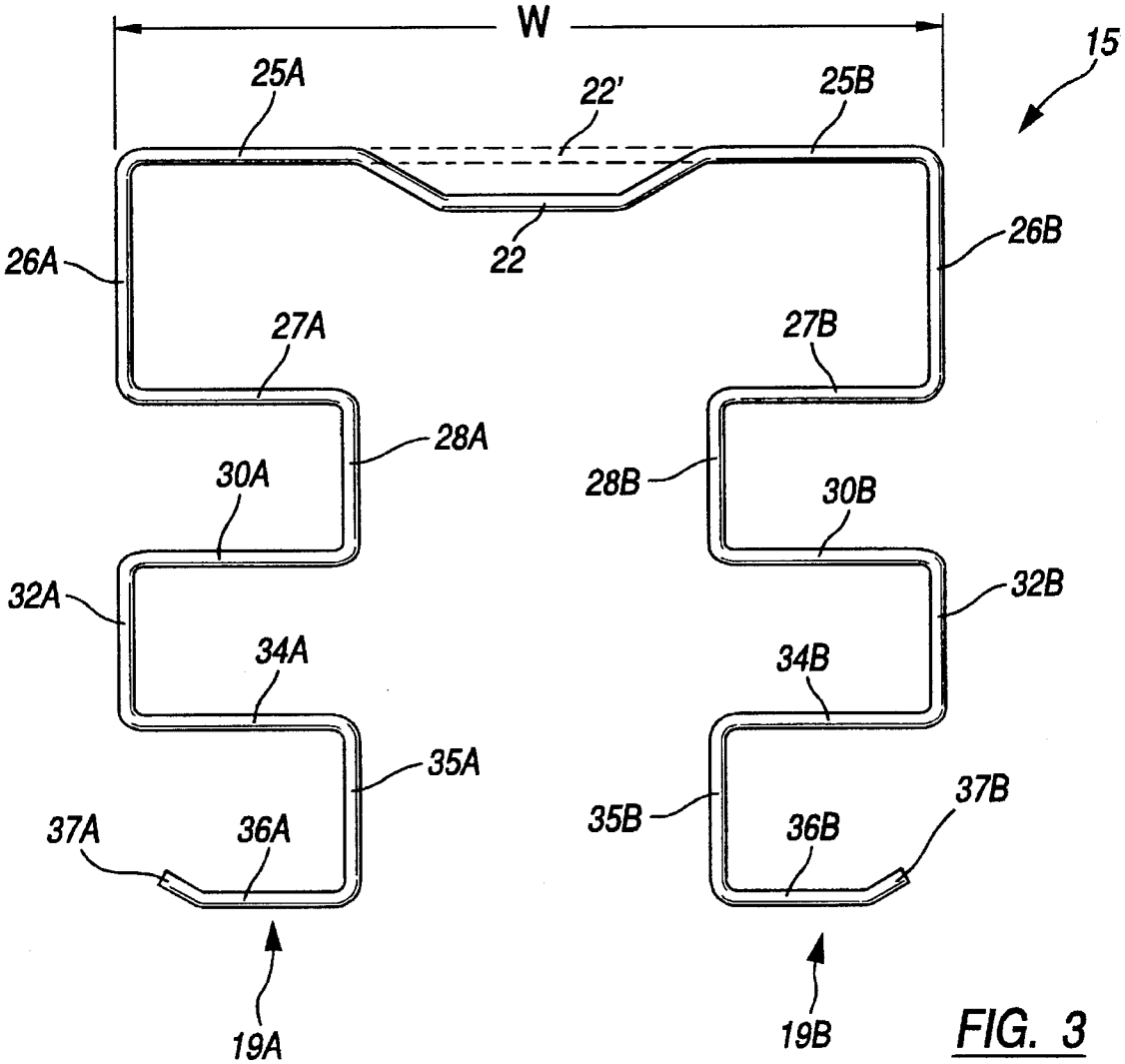

Referring now to FIGS. 3 and 4, each torsion edge support unit 15 includes two leg portions 19A, 19B linked together by a center link 22 (an alternate link 22' is shown in phantom). Leg portion 19A includes a horizontal top portion 25A, an upper vertical portion 26A, an upper horizontal torsion bar 27A, an upper inclined portion 28A, a middle horizontal torsion bar 30A, a lower inclined portion 32A, a lower horizontal torsion bar 34A, a lower vertical portion 35A, a lower horizontal portion 36A, and a stub portion 37. Leg portion 19B includes corresponding elements.

As shown in FIG. 4, with the exception of elements 28, 30, and 32, the torsion unit 15 lies in a common plane "P" bounding the side of the innerspring construction 10. This plane may be referred to as an innerspring construction side wall plane, in that it is the plane that a side wall (which includes the straight upper and lower border wire portions) of an innerspring construction lies in.

Figure 5:
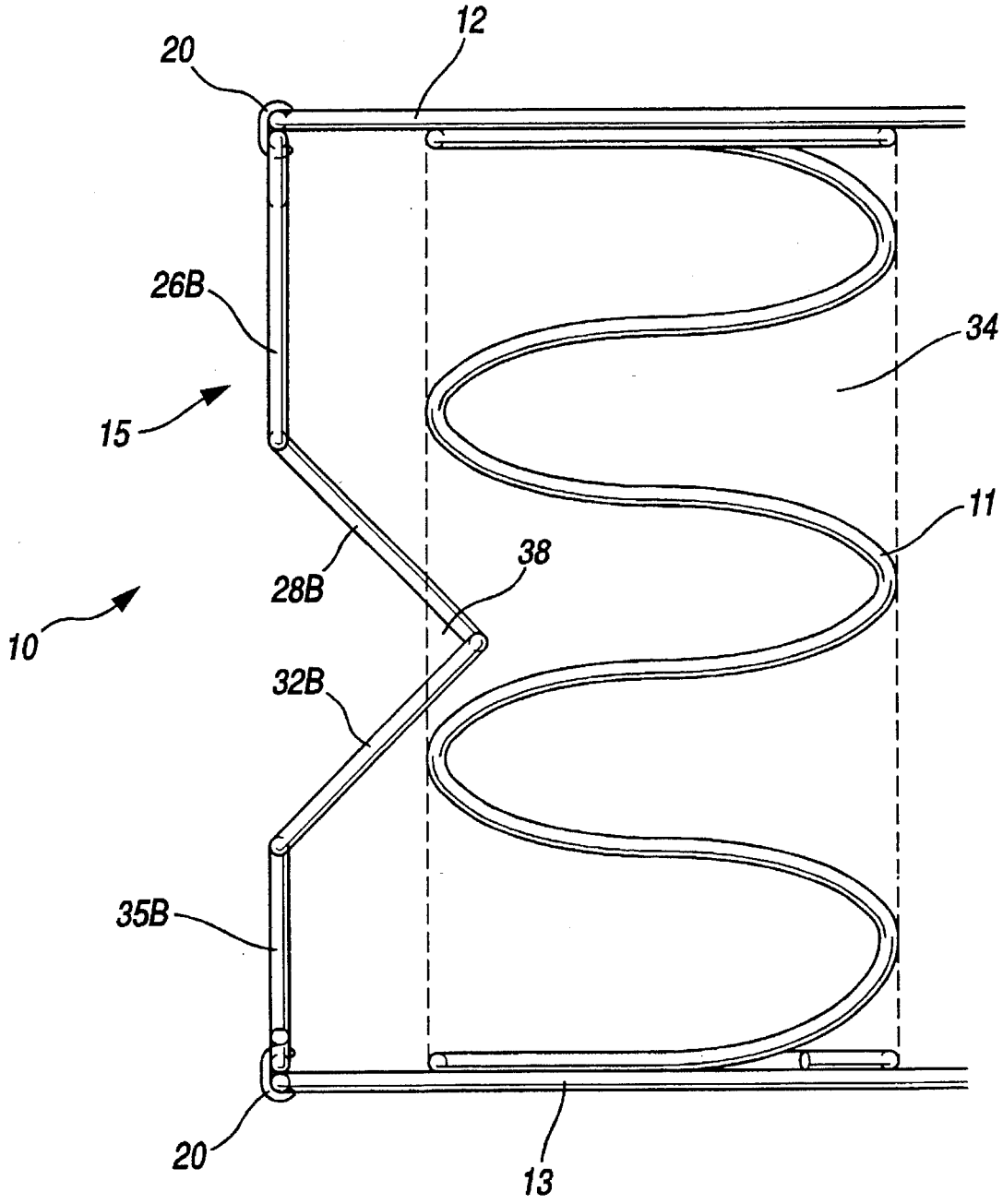
FIGS. 5 and 6 are partial side plan views of an innerspring construction as shown in FIG. 1, illustrating a unit deflecting from that shown in FIG. 5 to that shown in FIG. 6, due to a force F.
Figure 6:
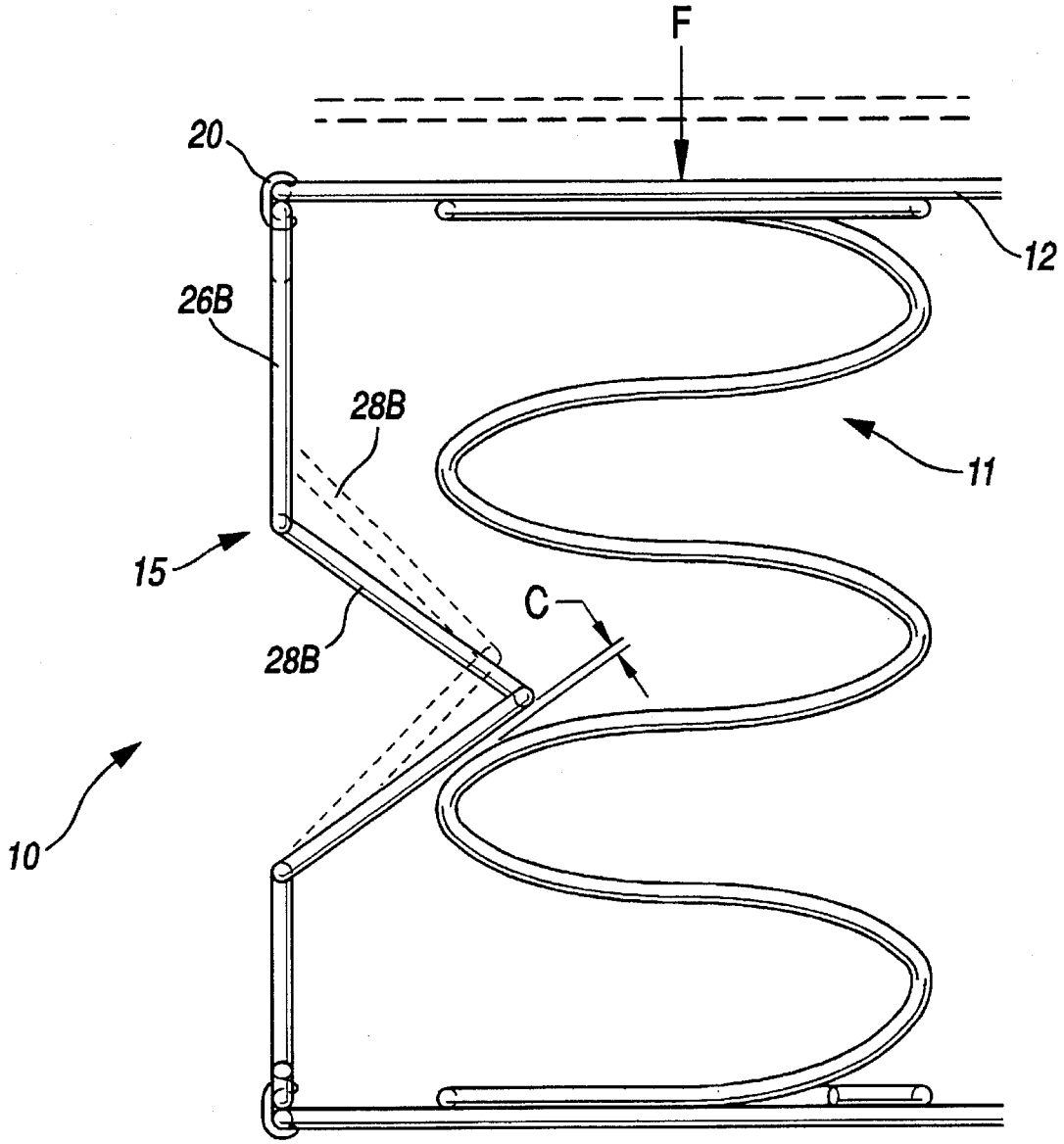

Referring now to FIGS. 5 and 6, the load-carrying characteristics of the torsion units 15 within the mattress is discussed. FIG. 5 illustrates the edge of a mattress construction without upholstery. A torsion edge support unit 15 is clipped in place by clips 20 as described above. In this instance, one of the interior coil springs 11 is adjacent to the torsion edge support unit 15 so as to allow both of the middle torsion bars 30 (which are substantially horizontal in actual use) to intersect the "spacial volume" 34 of the coil spring 11. For purposes of this discussion the "spacial volume" of a coil spring is the elongate, substantially barrel-shaped right-cylindrical volume 34 which is bounded by an imaginary surface 35 which follows the coil convolutions. In the claims as filed, the middle torsion bars are "first" bars and the upper torsion bars are "second" bars. Bars 34 are "third" bars.

As may be understood, the torsion edge support unit 15 of FIG. 5 includes an interfering portion 38 which extends within the spacial volume 34 of the interior coil spring 11. Preferably, at least some of the units 15 and springs are positioned as shown in FIGS. 5 and 6 to allow for close positioning of the two members but to still maintain a clearance "C" discussed in reference to FIG. 5. As may be seen, as a load F is placed atop the springs 11 and unit 15, they will both tend to deflect downwardly; the present invention allows for such movement while still allowing for the clearance "C", thus reducing the chances of metal-to-metal contact and the result of squeaking.

When the coil spring 11 is compressed axially, its convolutions tend to be compressed more tightly together as well understood. With respect to the torsion edge support unit 15, such axial compression causes the unit to deflect as shown in FIG. 6. Spring action is provided at least partially by torsional twisting action in the upper, middle, and lower torsion bars 27, 30, 34, and to a lesser extent bending action in the upper, middle, and lower torsion bars and the upper and lower inclined portions 28, 32, respectively.

In the embodiment shown in FIG. 2, four clips 20 are used to mount each torsion edge support unit 15 in place. The clips may be those as sold under the HARTCO trademark, or may be "hog rings" as known in the industry, or may be other means for attaching two adjacently-positioned wire sections as known in the art. In one preferred embodiment shown in FIGS. 5 and 6, the upper horizontal portions 25A, B of the unit 15 are clipped beneath the upper border wire 12, and the lower horizontal portions 36A, B, are clipped atop the lower border wire 13.

Figure 8:
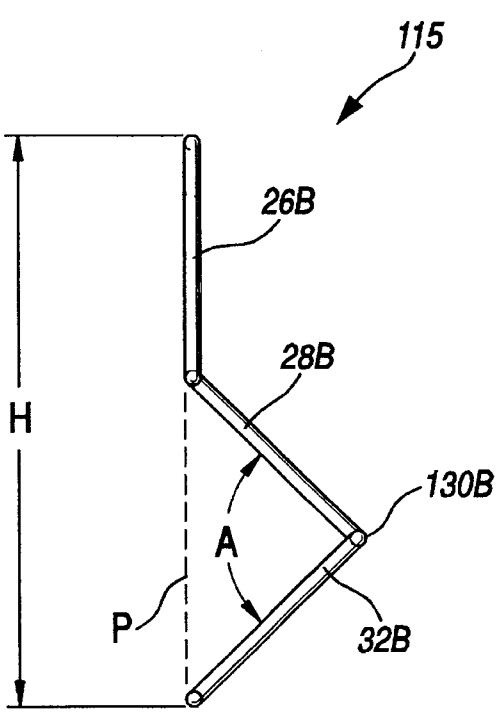
FIG. 7 and 8 are front and side plan views, respectively, of a second torsion edge support unit according to the present invention.
Figure 7:
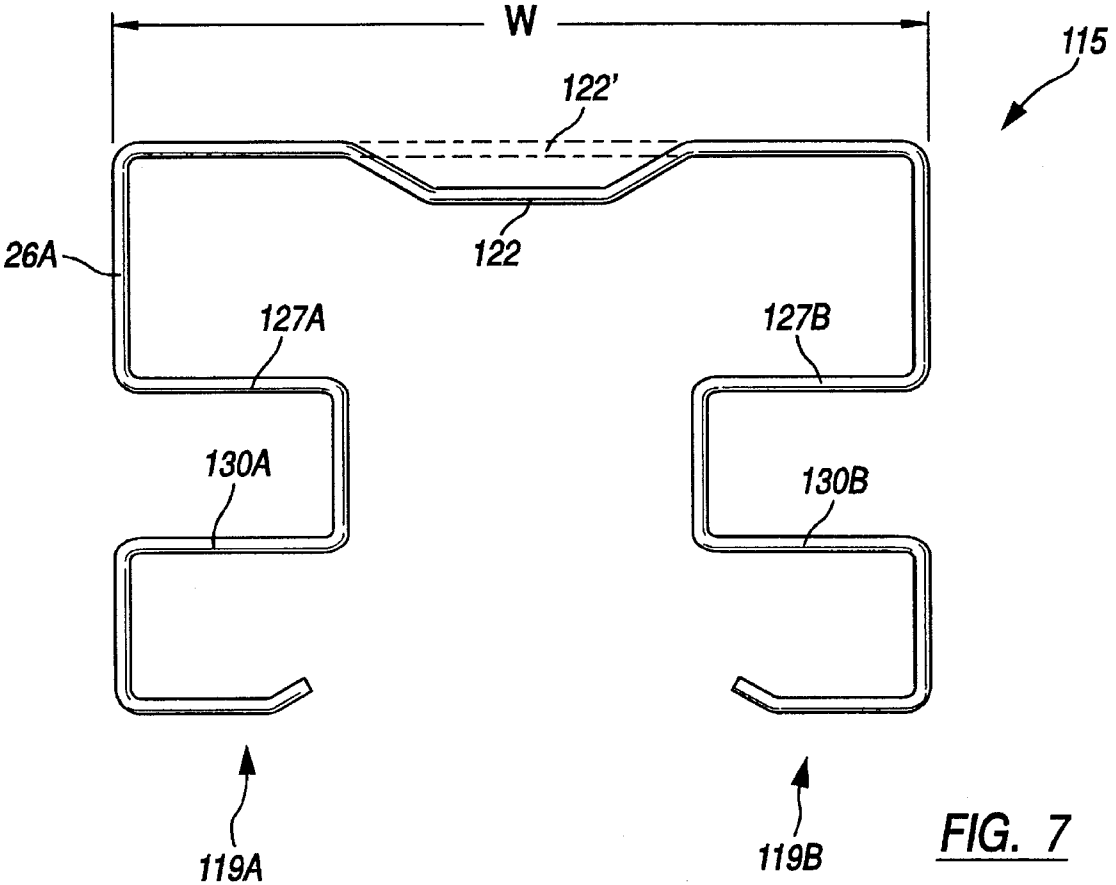
Figure 9:
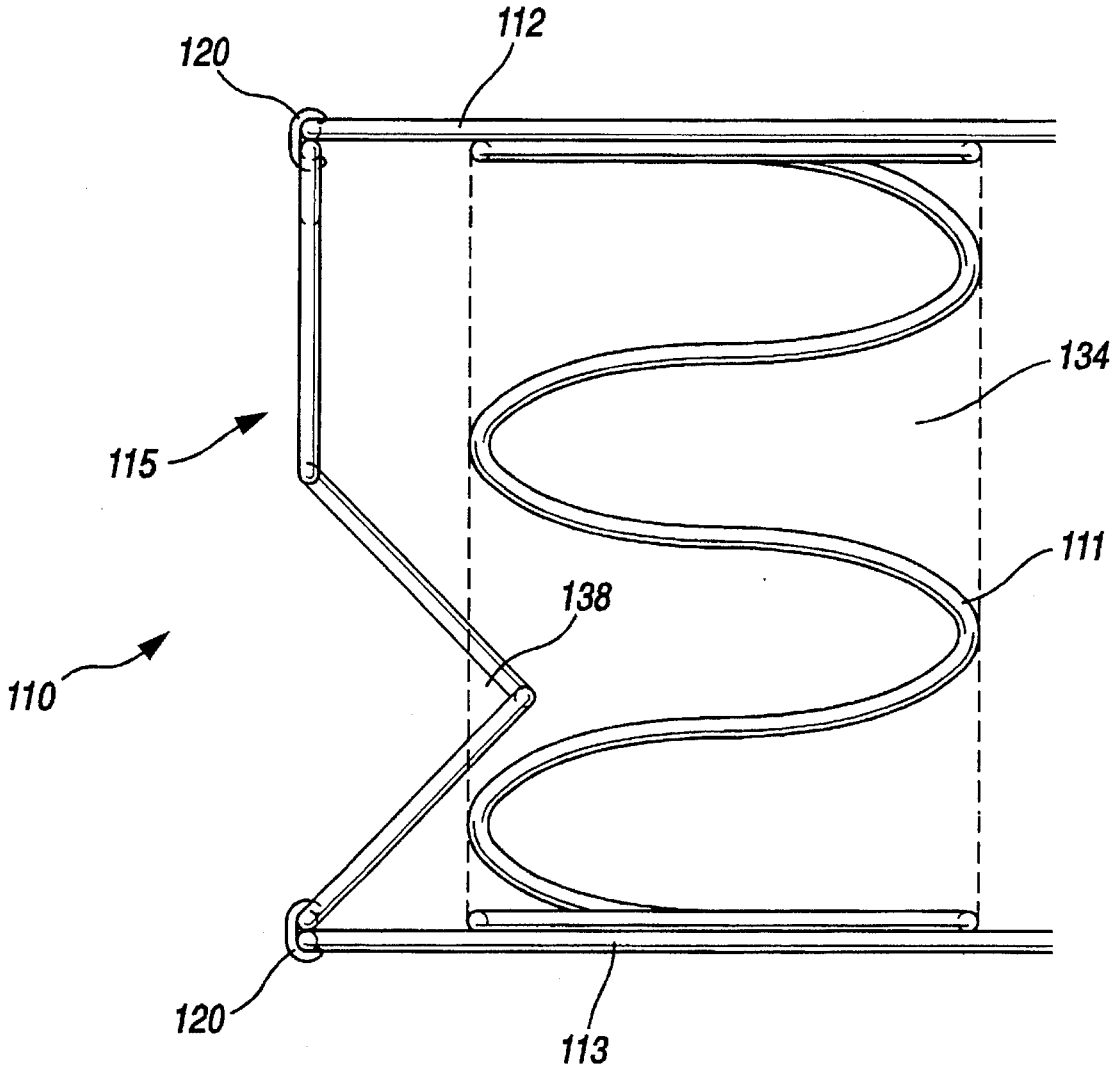
FIGS. 9 and 10 illustrate operation of the second unit of FIGS. 7 and 8.
Figure 10:
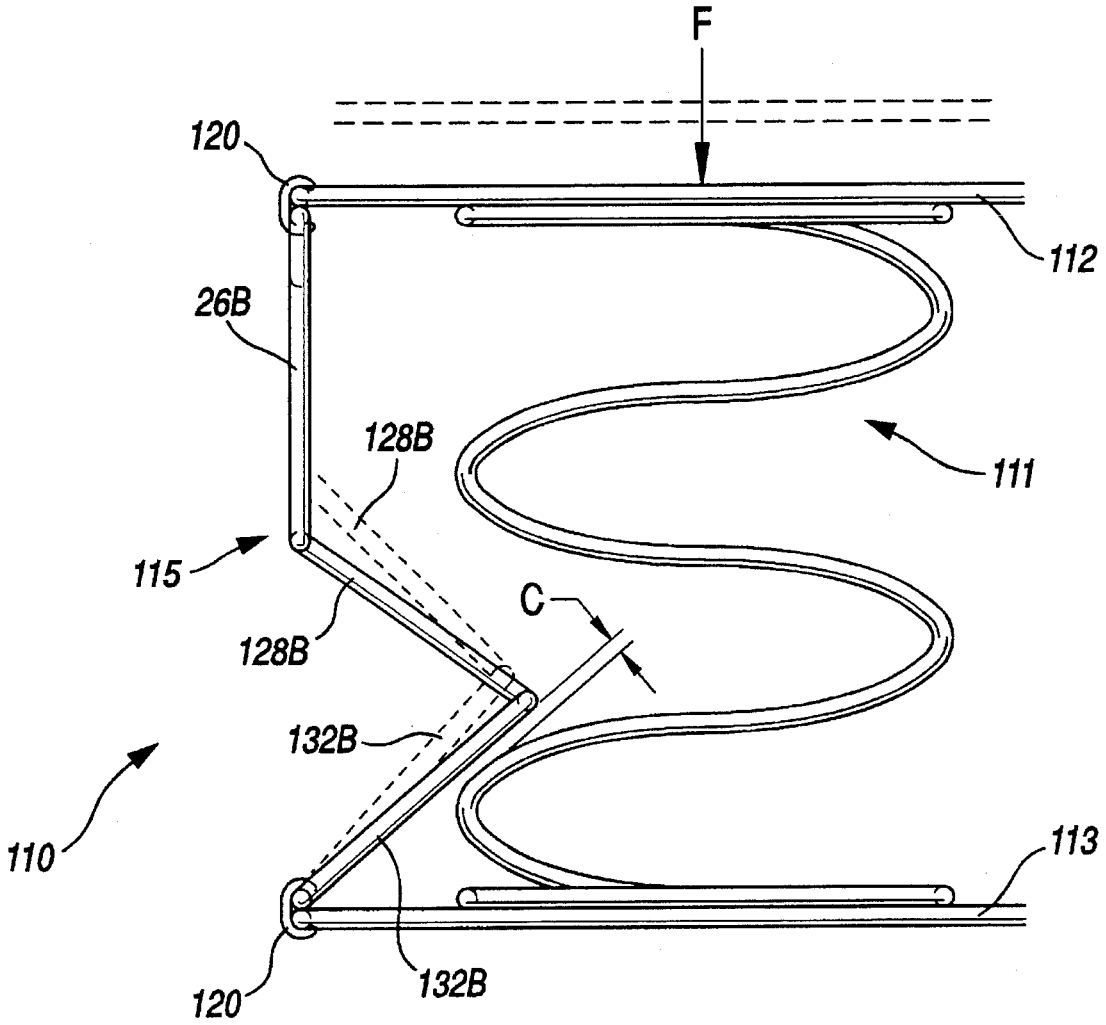

Referring now to FIGS. 7 and 8, a second preferred torsion edge support unit 115 is illustrated, which includes two torsion bars 127, 130, per leg 119 instead of three. These portions will be referred to as upper torsion bars 127 and lower torsion bars 130. However, as shown in FIGS. 9 and 10, this unit 115 still includes an interfering portion 138 which is capable of fitting intermediate convolutions of a coil spring 111, while providing clearance at "C" . In the claims as filed, bars 130 are "first" bars and bars 127 are "second" bars.

The mattress construction illustrated in FIG. 1 includes a total of six torsion edge support units 15, with two on each side, and one on each end. This "2/1" configuration is such as would be used in a twin or full size unit. A "3/2" configuration could be used in queen or king configurations. However, it should be noted that other combinations could be used without departing from the spirit and scope of the present invention.

It should be understood that although the use of open-coil interior springs was discussed in connection with the drawings, pocketed coil constructions, such as those shown in U.S. Pat. No. 4,234,983, entitled "Thermally Welded Spring Pockets" could also be used. In such an instance, the lower torsion bar of the spring 15 would have to push the fabric inward if the coils were positioned as closely as in FIG. 3.

Therefore, it may be seen that the present invention provides an improvement over the prior art by providing an innerspring construction which provides improved firmness and stability to the peripheral edge of the innerspring unit. A torsion edge support unit used within the innerspring unit provides superior firmness, discourages the bed occupant from rolling off the edge of the innerspring unit, and provides resistance to set caused by repeated sitting on the edge of the bed. Side wall integrity is also provided by the existence of several elements in the mattress innerspring construction side wall plane.

While this invention has been described in specific detail with reference to the disclosed embodiments, it will be understood that many variations and modifications may be effected within the spirit and scope of the invention as described in the appended claims.

What is claimed is:

1. An innerspring mattress construction comprising:

a) an upper peripheral border wire having an elongate portion lying along a first axis;

b) a lower peripheral border wire having an elongate portion lying along a second axis, said first and second axes lying within an innerspring construction side wall plane;

c) at least one coil spring providing spring resistance to a force placed atop said mattress innerspring construction;

d) a torsion edge support unit having an upper horizontal portion attached to said elongate portion of said upper peripheral border wire and having a lower horizontal portion attached to said elongate portion of said lower peripheral border wire, and having a first torsion bar positioned within the spacial volume of said interior coil spring and a second torsion bar lying approximately in the same plane as said innerspring construction side wall plane, said torsion edge support providing resistance to a force tending to urge said respective elongate portions of said upper and lower border wires closer together.

2. The innerspring mattress construction as claimed in claim 1, wherein said torsion edge support unit further comprises a third torsion bar lying approximately in said side wall plane of said innerspring construction.

3. The innerspring mattress construction as claimed in claim 1, further comprising upholstery material enveloping all previously discussed elements, such that said second torsion bar tends to discourage upholstery material from being pushed into the interior of said innerspring construction.

4. The innerspring mattress construction as claimed in claim 1, wherein said first and second torsion bars are substantially straight and parallel.

5. The innerspring mattress construction as claimed in claim 4, wherein said torsion edge support unit further comprises a third torsion bar lying approximately in said side wall plane of said innerspring construction.

6. The innerspring mattress construction as claimed in claim 5, further comprising upholstery material enveloping all previously discussed elements, such that said second and third torsion bars tend to discourage upholstery material from being pushed into the interior of said innerspring construction.

7. The innerspring mattress construction as claimed in claim 1, further comprising upholstery material enveloping all previously discussed elements, such that said second torsion bar tends to discourage upholstery material from being pushed into the interior of said innerspring construction.

8. A wire-formed torsion edge support unit for use along the peripheral edge of a mattress innerspring construction to provide additional support at said peripheral edge, said innerspring construction including a plurality of coil springs and defining an edge plane, said wire-formed support unit comprising the following wire portions attached end-to-end in sequential order:

a) an upper horizontal portion;

b) an upper vertical portion;

c) an upper torsion bar;

d) an upper inclined portion;

e) a middle torsion bar;

f) a lower inclined portion;

g) a lower torsion bar;

h) a lower vertical portion; and i) a lower horizontal portion, said unit configured such that elements a, b, c, g, h, and i lie within said edge plane of said innerspring construction, and elements d, e, and f extend within the spacial volume of a coil spring of said innerspring construction.

9. The spring as claimed in claim 8 wherein elements c and e are substantially elongate and parallel.

10. The spring as claimed in claim 9, wherein said torsion edge support unit is comprised of 8½ gauge spring steel.

11. The spring as claimed in claim 9, wherein said torsion edge support unit is comprised of 9 gauge spring steel.

12. A wire-formed torsion edge support unit for use along the peripheral edge of a mattress innerspring construction to provide additional support at said peripheral edge, said innerspring construction including a plurality of coil springs and defining an edge plane, said wire-formed support unit comprising the following wire portions attached end-to-end in sequential order:

a) an upper horizontal portion;

b) an upper vertical portion;

c) an upper torsion bar;

d) an upper inclined portion;

e) a lower torsion bar;

f) a lower inclined portion;

g) a lower horizontal portion, said unit configured such that elements a, b, c, and g lie within said edge plane of said innerspring construction, and elements d, e, and f extend within the spacial volume of a coil spring of said innerspring construction.

13. The spring as claimed in claim 12 wherein elements c and e are substantially elongate and parallel.

14. The spring as claimed in claim 13, wherein said torsion edge support unit is comprised of 8½ gauge spring steel.

15. The spring as claimed in claim 13, wherein said torsion edge support unit is comprised of 9 gauge spring steel.

* * * * *